US008267570B2

(12) United States Patent
Lai et al.

(10) Patent No.: US 8,267,570 B2
(45) Date of Patent: Sep. 18, 2012

(54) FIXED BASE AND LIGHTING DEVICE UTILIZING THE SAME

(75) Inventors: Jin-Shi Lai, Shenzhen (CN); Kim-Yeung Sip, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 478 days.

(21) Appl. No.: 12/693,415

(22) Filed: Jan. 25, 2010
(Under 37 CFR 1.47)

(65) Prior Publication Data

US 2011/0002130 A1 Jan. 6, 2011

(30) Foreign Application Priority Data

Jul. 6, 2009 (CN) ..... 2009 1 0304036

(51) Int. Cl.
*H01R 33/00* (2006.01)

(52) U.S. Cl. ..... 362/652; 362/651; 362/655; 362/656; 362/657; 362/658

(58) Field of Classification Search ..... 362/651–652, 362/655–659
See application file for complete search history.

(56) References Cited

U.S. PATENT DOCUMENTS 5,669,703 A * 9/1997 Wheeler et al. ..... 362/249.04
6,976,776 B2 * 12/2005 Kakidaira et al. ..... 362/548
7,905,626 B2 * 3/2011 Shantha et al. ..... 362/228

* cited by examiner

*Primary Examiner* — Diane Lee
*Assistant Examiner* — Sean Gramling
(74) *Attorney, Agent, or Firm* — Altis Law Group, Inc.

(57) ABSTRACT

A fixed base comprises an upper cover comprising an outer canister a top plate and a sidewall. The sidewall encircles the top plate to form a receiving room. An inner canister penetrates the receiving room and is attached to the top plate, which comprises a wall. At least one hatch is defined in the wall, and is connected to the receiving room. A positioning component is set inside the surface of the top plate. A limitation frame comprises a frame body, a connecting block, and a positioning block. The positioning block is slidably connected to the positioning component. At least one groove opposite the hatch is defined in the wall of the frame body, and comprises a sliding groove and a fixing groove connecting with the sliding groove. The fixed base further comprises a driver and a trigger switch.

17 Claims, 9 Drawing Sheets

FIXED BASE AND LIGHTING DEVICE UTILIZING THE SAME

BACKGROUND

1. Technical Field

The present disclosure relates to a fixed base and a lighting device utilizing the fixed base.

2. Description of Related Art

Light emitting diode (LED) is widely used in various lighting devices. When the LED is disabled, users must replace the disabled LED with a new LED. However, configuration of the lighting device is complicated, and so is replacing the disabled LED.

Therefore, what is needed is a fixed base to overcome the shortcoming described.

DETAILED DESCRIPTION

Figure 1:
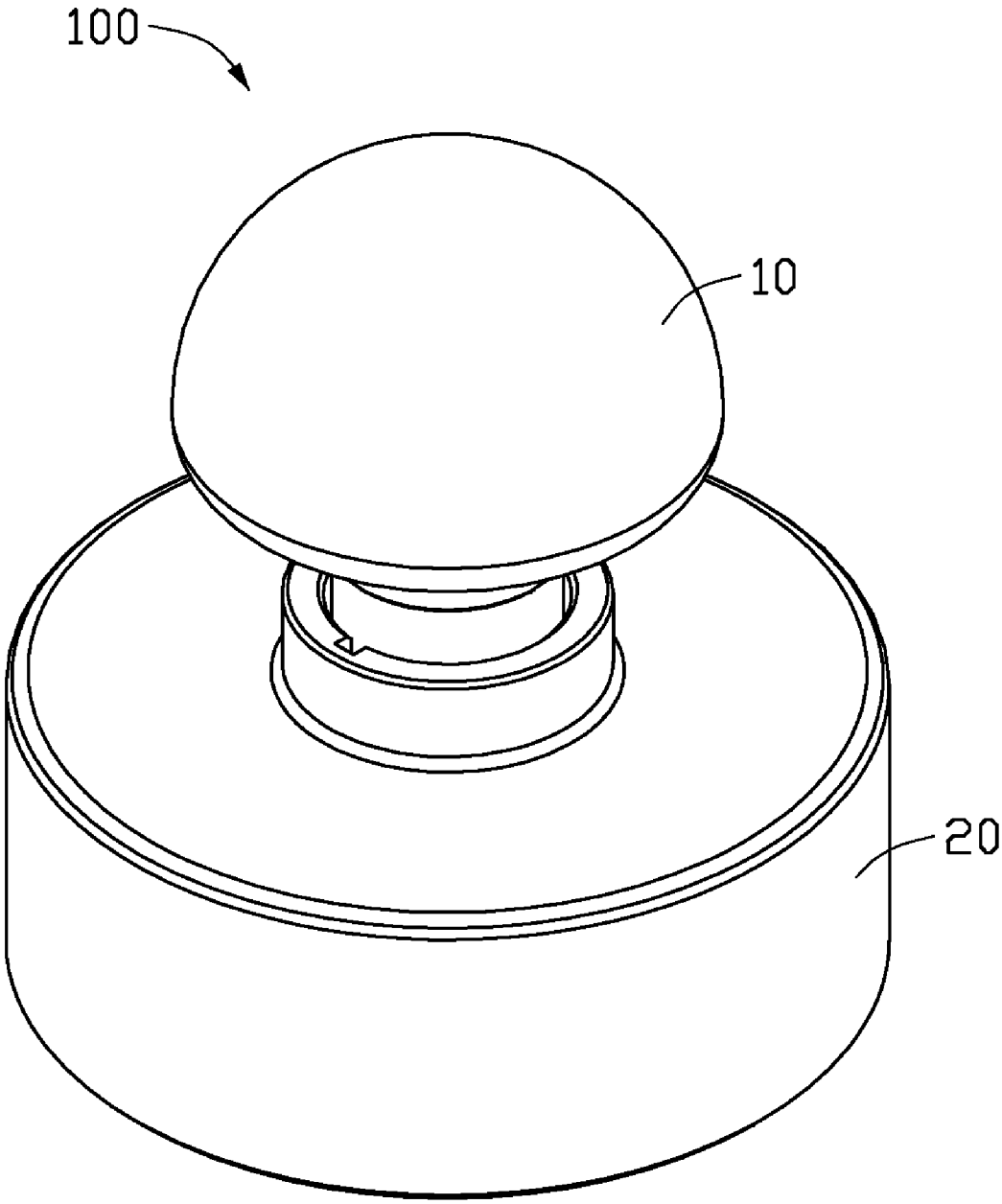
FIG. 1 is an isometric view of a lighting device in a assembled state, in accordance with an exemplary embodiment.

Referring to FIG. 1, an embodiment of a lighting device 100 is provided. The lighting device 100 includes a lighting member 10 and a fixed base 20.

Figure 2:
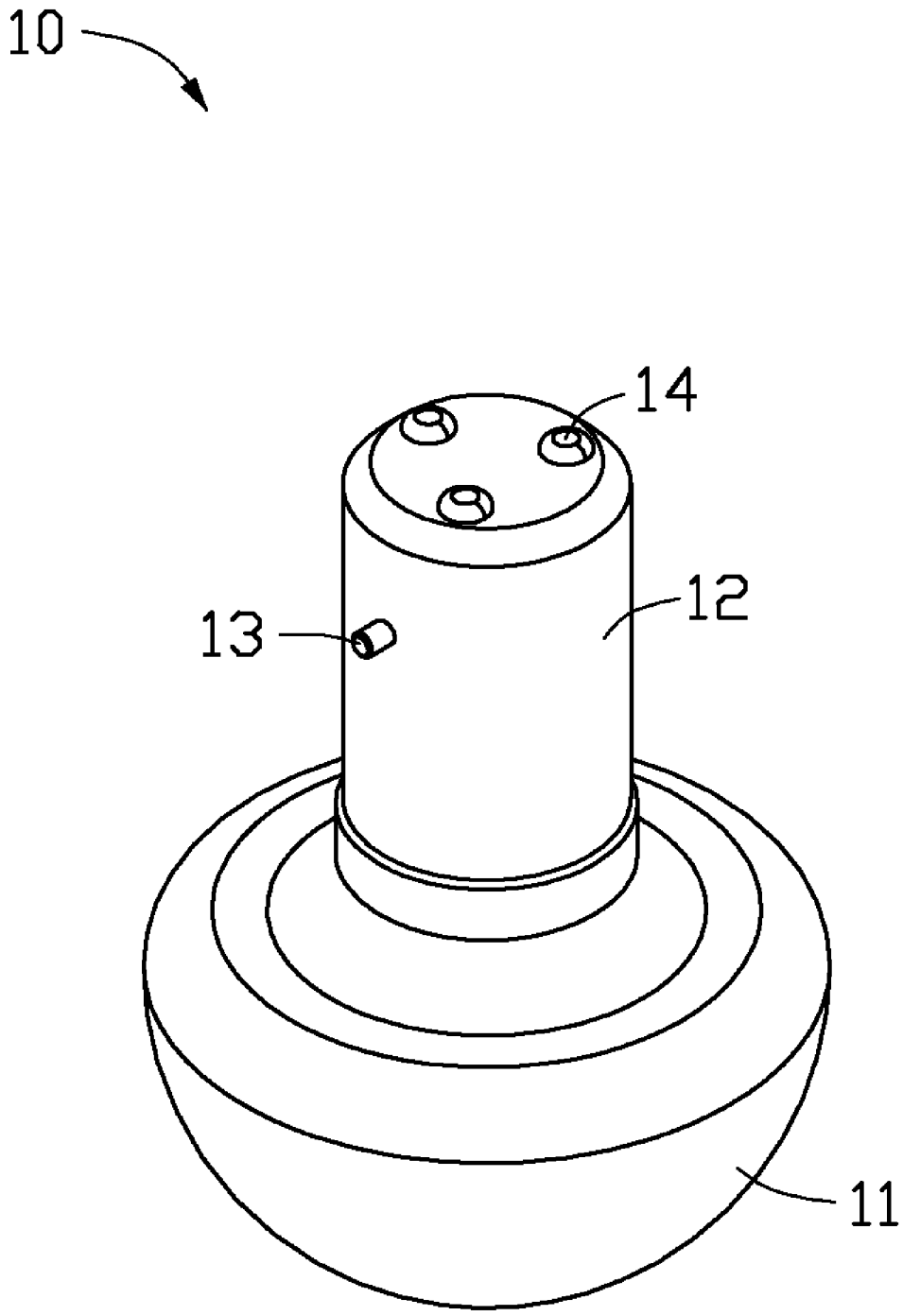
FIG. 2 is an isometric view of a lighting member of the lighting device of FIG. 1.

Referring to FIG. 2, the lighting member 10 includes a half-sphere shaped luminophor 11, a support column pole 12, two poles 13 set on the circumferential surface of the support column pole 12, and three electrodes 14 set in a bottom of the support column pole 12. The three electrodes 14 are electronically connected to the luminophor 11. In the exemplary embodiment, the luminophor 11 is a light emitting diode (LED).

Figure 3:
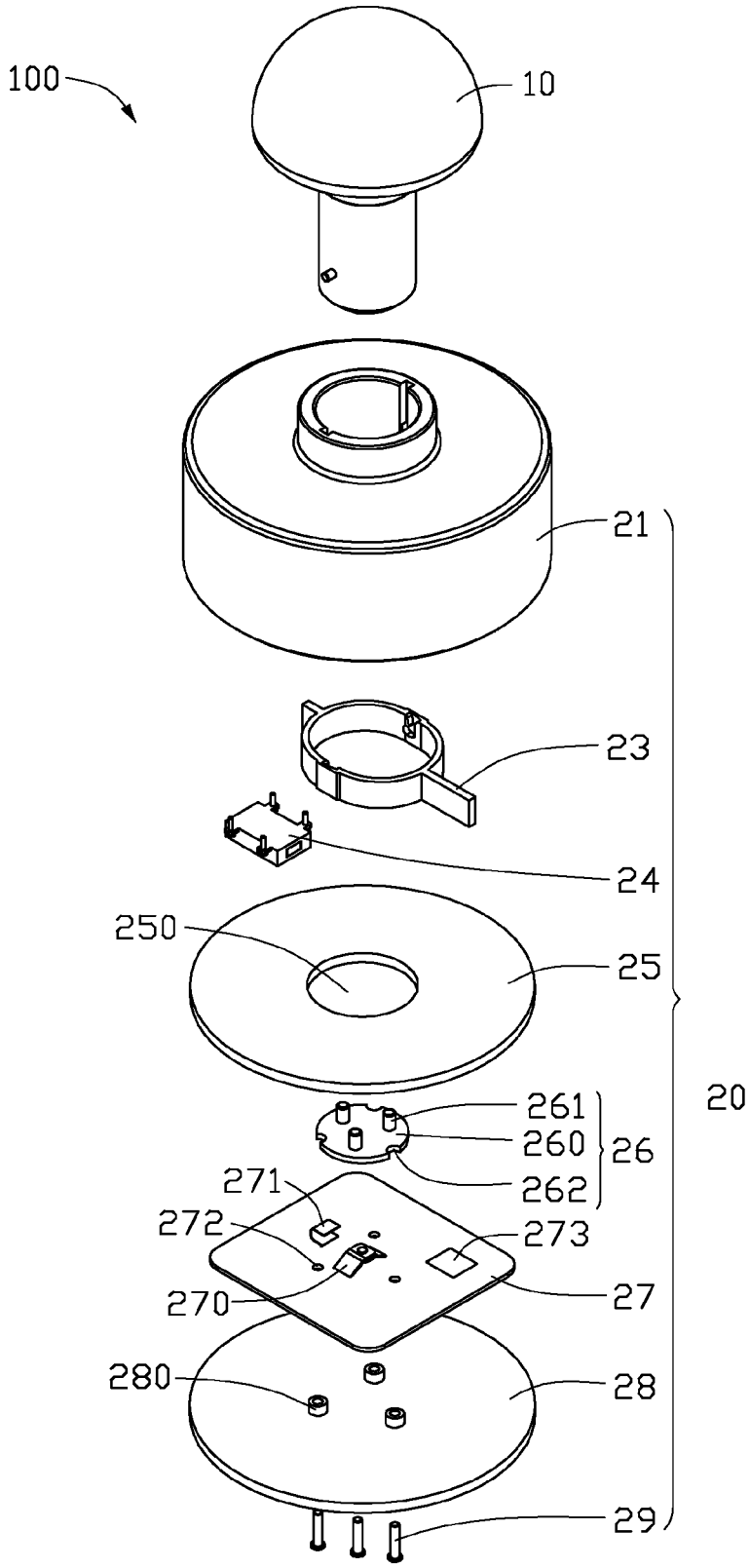
FIG. 3 is an exploded view of the lighting device of FIG. 1.

Referring to FIG. 3, the fixed base 20 includes an upper cover 21, a limitation frame 23, a driver 24, a mid-plate 25, a touch component 26, a circuit board 27, a lower cover 28, and three first bolts 29.

Figure 4:
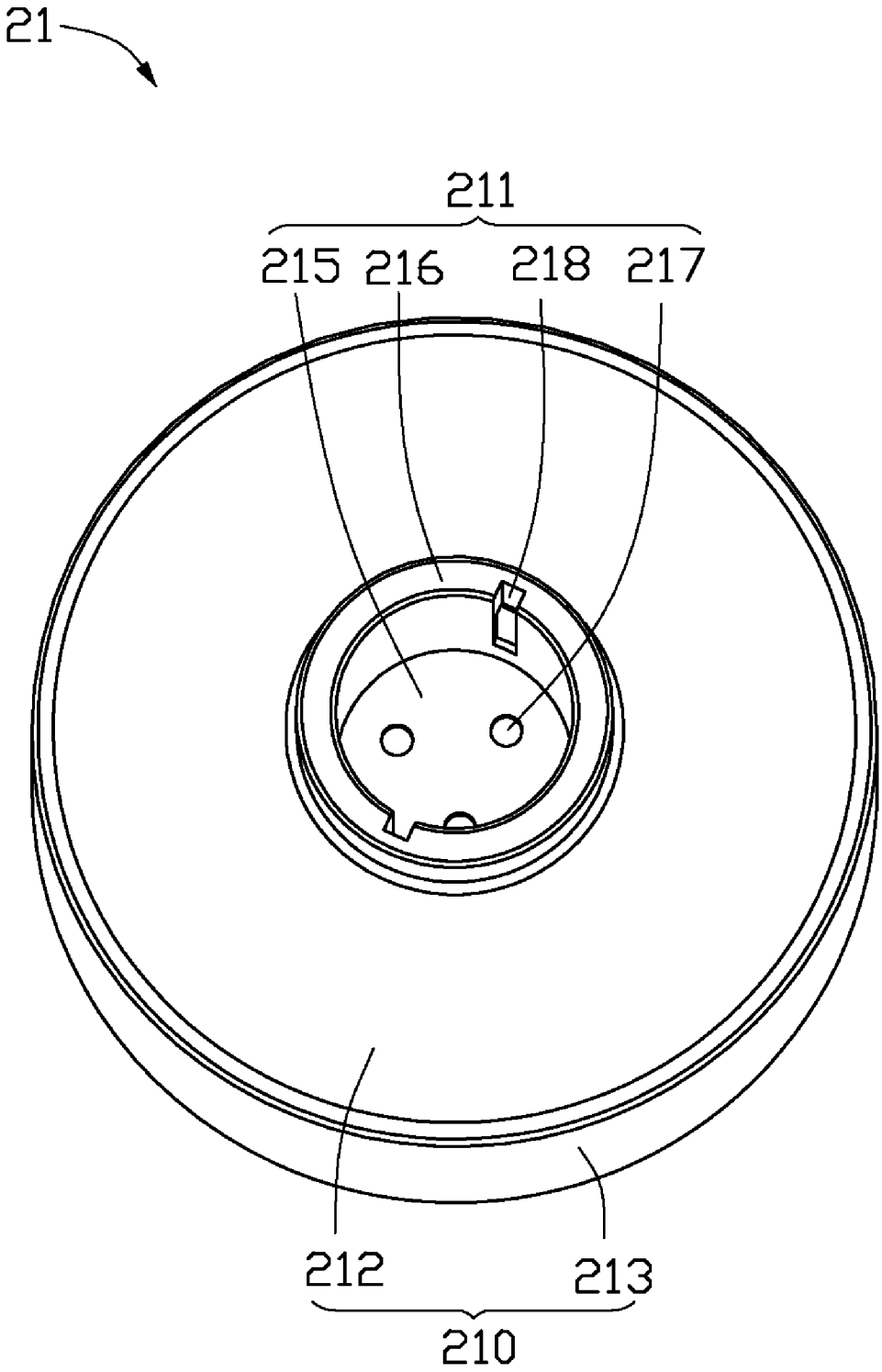
FIG. 4 is an isometric view of an upper cover of the lighting device of FIG. 1.
Figure 5:
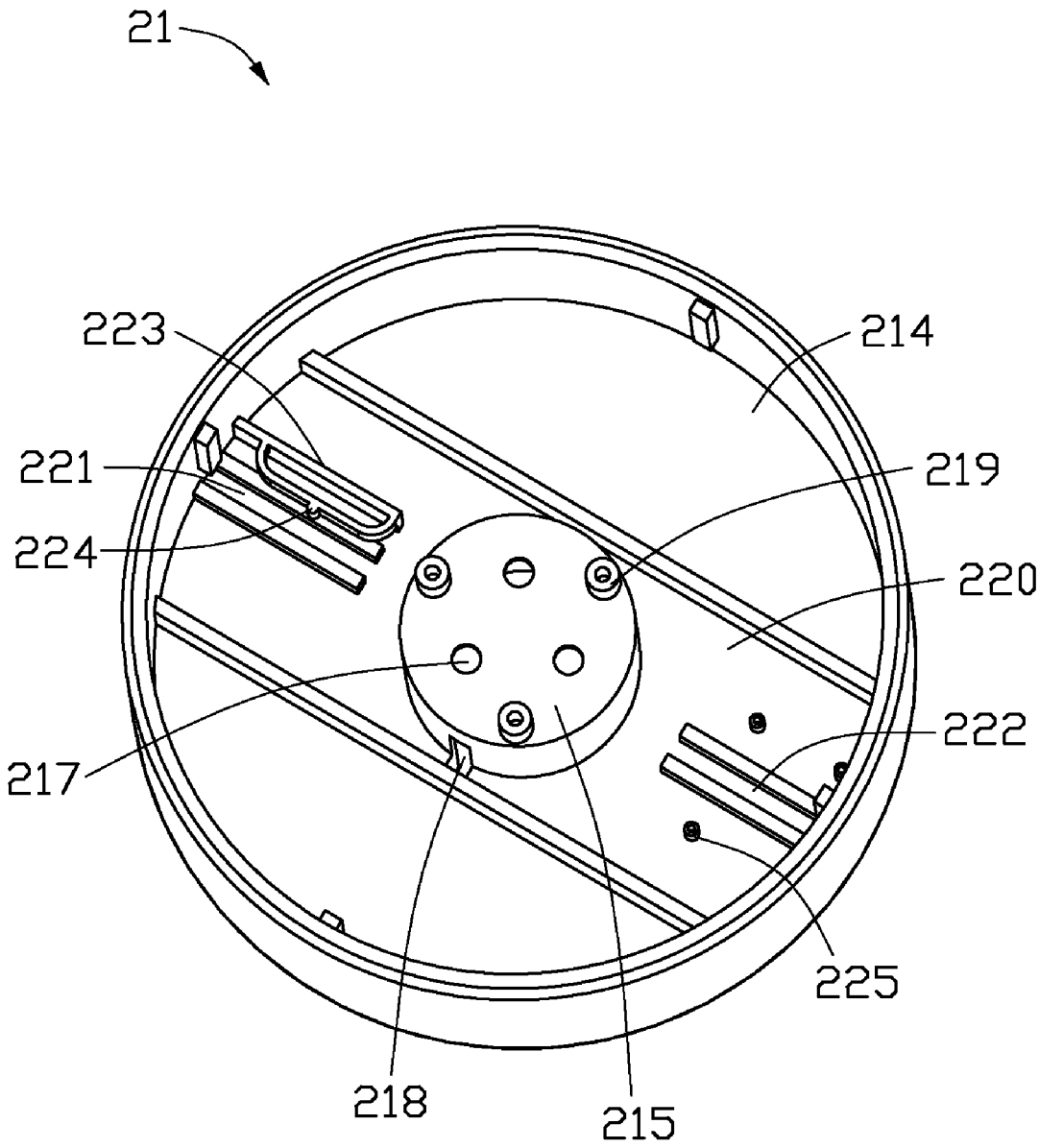
FIG. 5 is an isometric view of an upper cover of the lighting device of FIG. 1, viewed from another aspect.

Referring to FIGS. 4-5, the upper cover 21 includes an outer columnar canister 210 and an inner columnar canister 211 sharing a common axis with the outer canister 210. The outer canister 210 includes a top plate 212 and a sidewall 213 encircling the top plate 212. The sidewall 213 encircles the top plate 212 to form a receiving room 214. The inner canister 211 penetrates the receiving room 214, and is fixed on the center of the top plate 212. The inner diameter of the inner canister 211 slightly exceeds that of the support column pole 12.

The inner canister 211 includes a bottom plate 215 and a wall 216 encircling the bottom plate 215. An outer end (not labeled) of the inner canister 211 protrudes from the top plate 212, and the inner end (not labeled) of the inner canister 211 is located inside of the outer canister 210. Axially, the thickness of the outer end exceeds that of the inner end. Three first through holes 217 are defined in the bottom plate 215. Two opposite rectangular hatches 218 are defined in the wall 216 along an axial direction of the inner canister 211. The three first through holes 217 and the two hatches 218 communicate with the receiving room 214. The width of each of the hatches 218 slightly exceeds the diameter of each of the two poles 13 in the circumferential direction of the wall 216. Three nuts 219 are set in one side of the bottom plate 215 towards the receiving room 214, and are column-shaped. A first guiding groove 220, a second guiding groove 221, and a third guiding groove 222 are formed in the inner surface of the top plate 212. The second guiding groove 221 and the third guiding groove 222 are located in the inside of the first guiding groove 220, and the second guiding groove 221 and the third guiding groove 222 are opposite each other and located in two sides of the inner canister 211. A P-shaped positioning component 223 is formed on one side of the second guiding groove 221. A protrusion 224 extends from a curved side of the positioning component 223. Two second nuts 225 are set on both sides of the third guiding groove 222 respectively.

Figure 6:
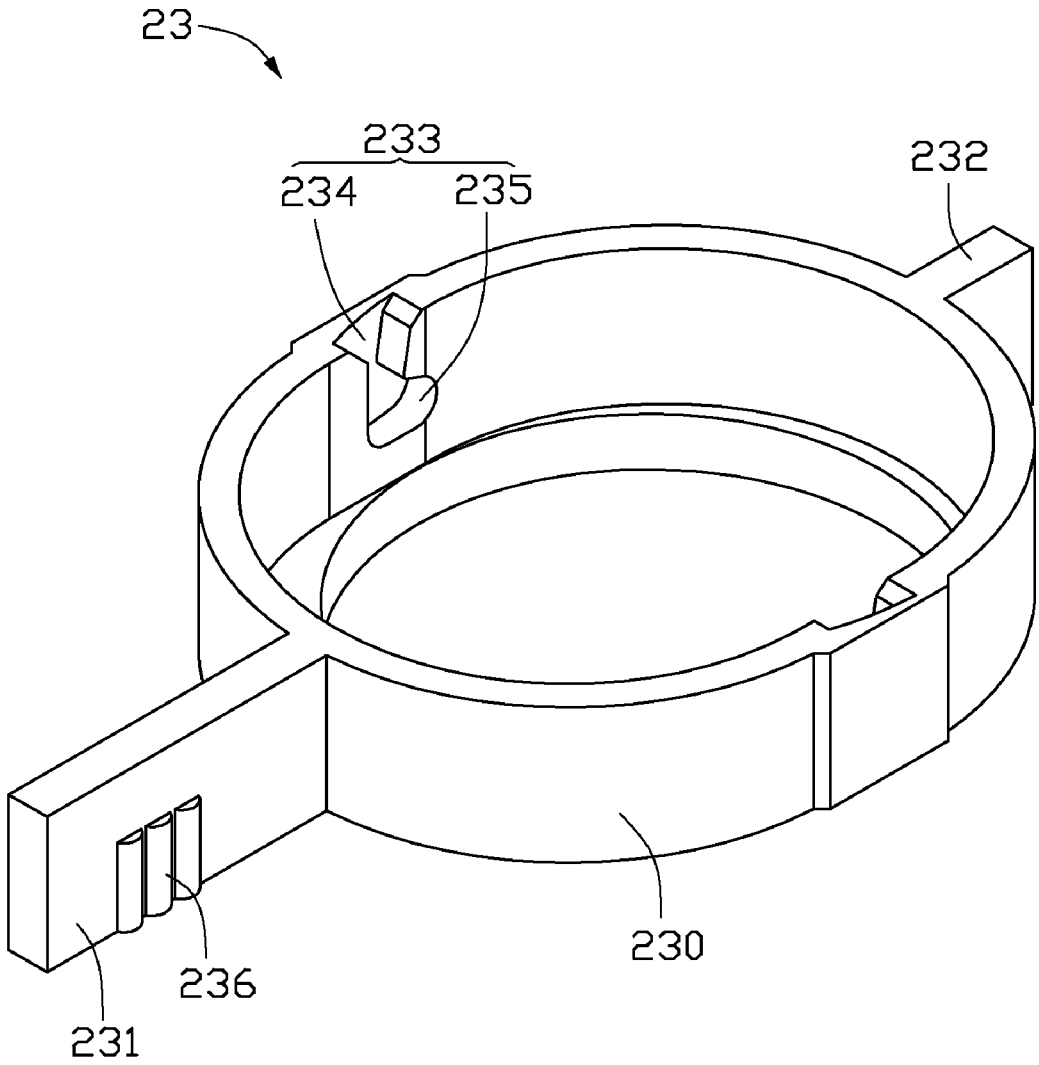
FIG. 6 is an isometric view of a limitation frame of the lighting device of FIG. 1.

Referring to FIG. 6, the limitation frame 23 includes a frame body 230, a positioning block 231, and a connecting block 232. The frame body 230 is hollow and oval-shaped. The positioning block 231 and the connecting block 232 are oppositely set in two ends of the frame body 230. Two L-shaped grooves 233 are oppositely defined in the inside of the frame body 230. Each groove 233 includes a sliding groove 234 and a fixing groove 235 connected to the sliding groove 234. A curved chamfer (not labeled) is formed at a junction between the sliding groove 234 and the fixing groove 235. The fixing groove 235 is located in one side of the sliding groove 234 adjacent to the connecting block 232. A positioning bar 236 is set in one side of the positioning block 231. Two positioning grooves (not labeled) are formed in the positioning bar 236. The thickness of the positioning block 231 and the thickness of the connecting block 232 is slightly less than the width of the second guiding groove 221 and the width of the third guiding groove 222 respectively.

Figure 7:
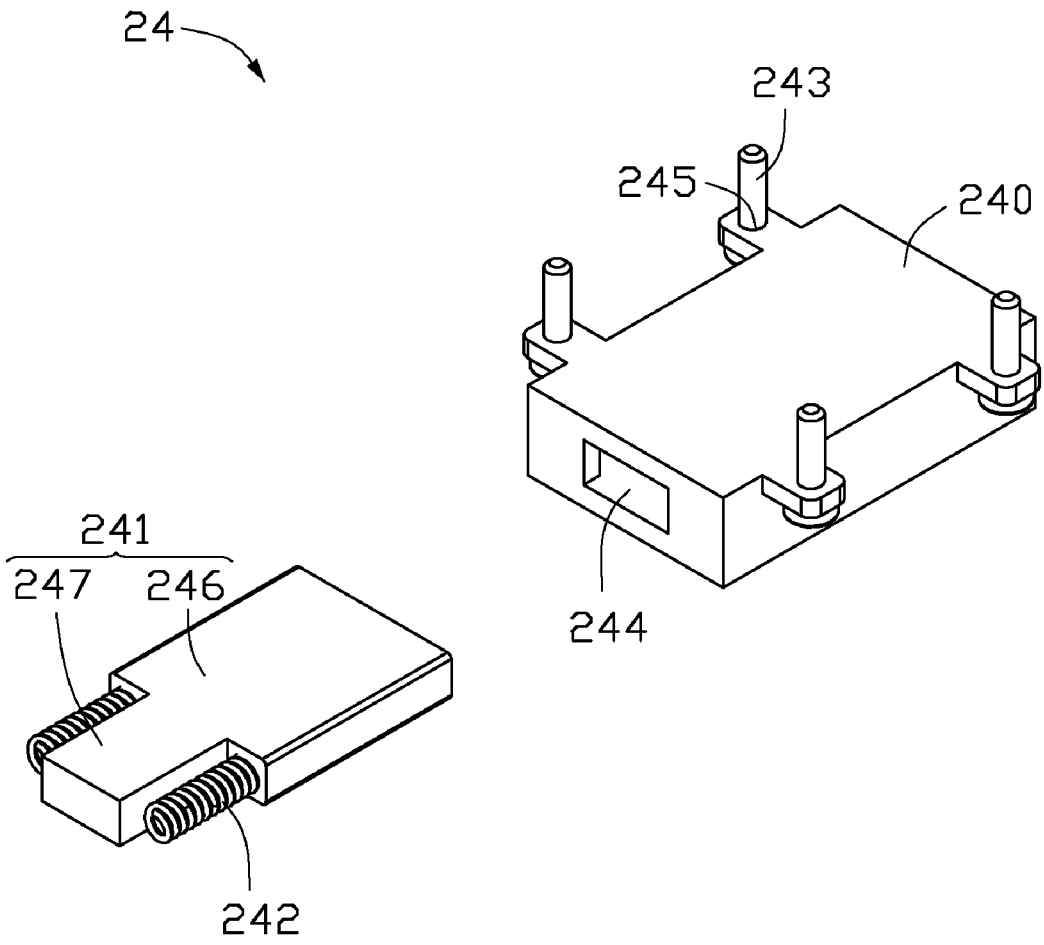
FIG. 7 is an exploded view of a driver of the lighting device of FIG. 1.

Referring to FIG. 7, the driver 24 includes an outer shell 240, an electromagnet 241, two reset springs 242, and four second bolts 243. A hatch 244 is defined in one end of the outer shell 240, and is rectangle-shaped. An opposite end of the outer shell 240 is magnetic. Four first threaded holes 245 are formed in the outer shell 240. The electromagnet 241 includes a magnetic portion 246 and a driving portion 247 connecting to the magnetic portion 246. The magnetic portion and the driving portion 247 are rectangular-shaped. The width of the driving portion 247 is less than that of the magnetic portion 246, and the size of the driving portion 247 is less than that of the hatch 244. The electromagnet 241 is located in the inside of the outer shell 240, the driving portion 247 is towards the hatch 244, and the magnetic portion 246 is opposite to the end of the magnetic outer shell 240. The two reset springs 242 are set on two sides of the driving portion 247 respectively, and resist the magnetic portion 246.

Referring to FIG. 3 again, the mid-plate 25 is circular. A second circular through hole 250 is defined in the center of the mid-plate 25. The diameter of the mid-plate 25 approximately equals the diameter of the receiving room 214. The diameter of the second through hole 250 approximately equals the inner diameter of the frame body 230, and slightly exceeds the outer diameter of the inert canister 211.

The touch component 26 includes a substrate plate 260 and three touch poles 261 mounted on the substrate plate 260. The three touch poles 261 are made of the conductive material, and are electronically connected to the substrate plate 260. The diameter of each of the three touch poles 261 is slightly less than the diameter of each of the three first through holes 217. Three semicircular cutouts 262 are defined in the edge of the substrate plate 260. The diameter of each of the three cutouts 262 approximately equals to the diameter of each of the three first nuts 219. The thickness of the substrate plate 260 is less than the height of each of the three first nuts 219 along an axial direction of the touch pole 260.

The circuit board 27 is a square board. An elastic trigger switch 270 and a connecting component 271 are set in the circuit board 27. A control circuit 273 is also set in the circuit board 27, and is electronically connected to the trigger switch 270 and the connecting component 271. The trigger switch 270 is configured for elastically compressing the circuit board 27 and generating a trigger signal to the control circuit 273 when receiving a pressure whose value exceeds a predetermined value. In the exemplary embodiment, the connecting component 271 is a flexible circuit board. Three second threaded holes 272 are defined in the circuit board 27, and are passed through the circuit board 27.

The lower cover 28 is a circular plate, and the diameter of the lower cover 28 approximately equals the diameter of the receiving room 214. Three third threaded holes 280 are defined in the lower cover 28, and are passed through the lower cover 28.

Figure 8:
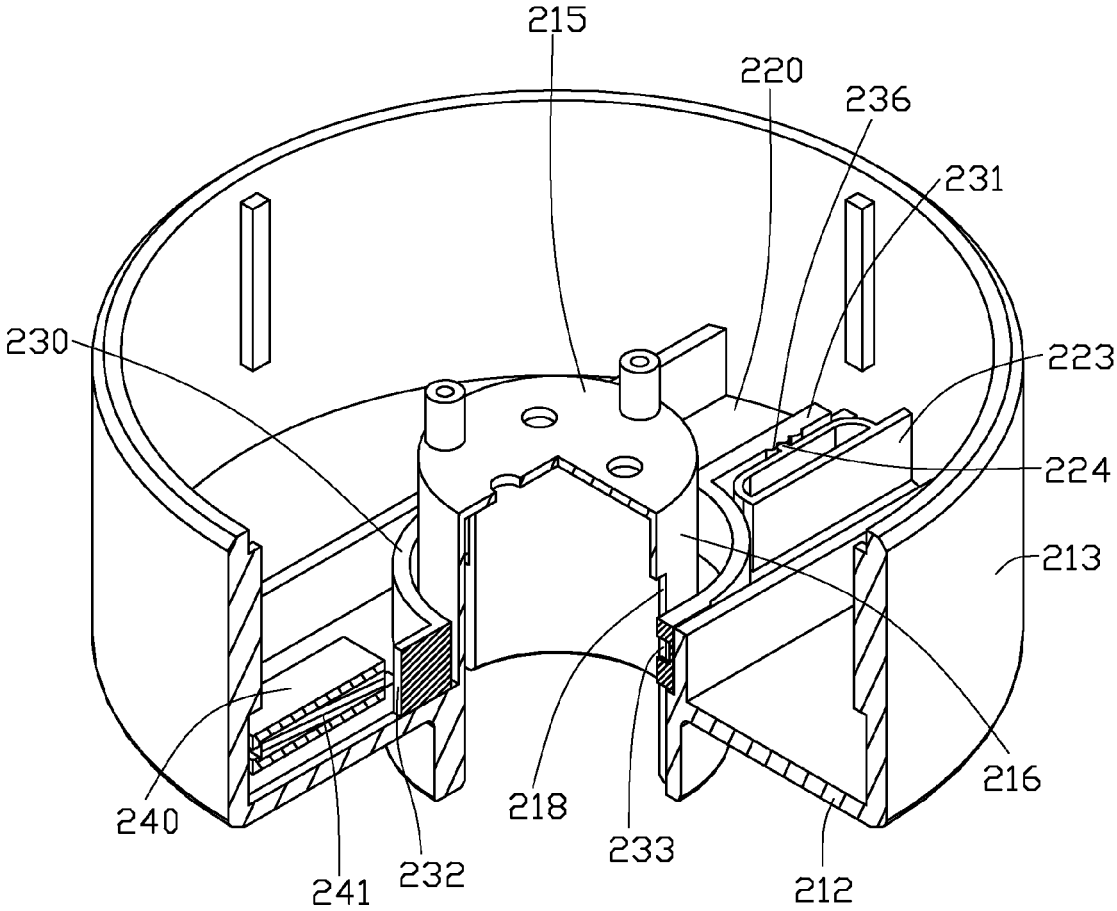
FIG. 8 is a cutaway view of the upper cover, the limitation frame and the driver of FIG. 1.
Figure 9:
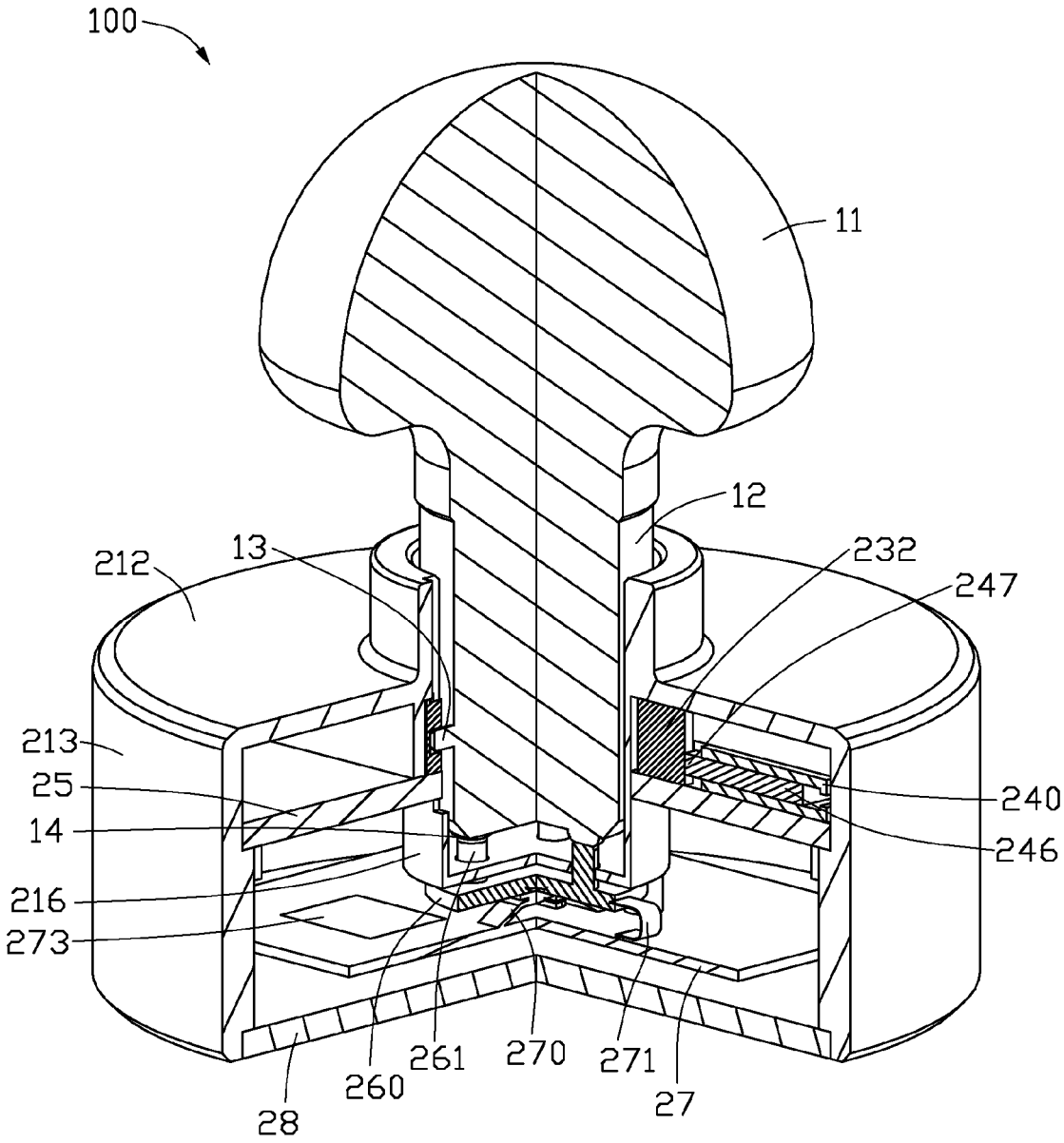
FIG. 9 is a cutaway view of the lighting device of FIG. 1.

Referring to FIGS. 8-9, when assembling the fixed base 20, firstly, the limitation frame 23 is located in the inside of the first guiding groove 220, and the frame body 230 encircles the inner canister 211. The positioning block 231 is located in the inside of the second guiding groove 221, the positioning bar 236 is meshed with the protrusion 224, and the connecting block 232 is located in the inside of the third guiding groove 222. Secondly, the sliding groove 234 is connected to the hatch 218. The four second bolts 243 penetrate the four first threaded holes 245, and are screwed with the four second nuts 225 so that the driver 24 is affixed to the third guiding groove 222. The driver 247 is oppositely set to the connecting block 24. Subsequently, the mid-plate 25 is covered with the driver 24 and the limitation frame 23, so that, the driver 24 and the limitation frame 23 are enveloped in the inside of the receiving room 214. The inner canister 211 penetrates the second through hole 250. The three touch poles 260 penetrate the three first through holes 217 to enter the inside of the inner canister 211, and the three cutouts 262 are placed over the first nuts 219, so that, the substrate plate 260 is engaged among the three first nuts 219. Finally, the circuit board 27 is covered on the substrate plate 260, and is resisted by three first nuts 219. The three second threaded holes 272 are opposite to the three first nuts 219. The trigger switch 270 is located between the substrate plate 260 and the circuit board 27, and resists the substrate plate 260. The connecting component 217 is electronically connected to the substrate plate 260, and the circuit board 27 is electronically connected to the driver 24. The lower cover 28 shields the circuit board 27, and the three third threaded holes 280 are opposite to the three second threaded holes 272. The three first bolts 29 penetrate the third threaded holes 280 and the second threaded holes 272, are screwed with the three first nuts 219, so that, the circuit board 27 is fixed to the lower cover 28.

When inserting the support column pole 12 of the lighting member 10 into the inner canister 211, the hook pole 13 is inserted into the sliding groove 234 along the hatch 218, so that, the three electrodes 14 touch the touch pole 260 and press the touch pole 260. Pressure from the substrate plate 260 is exerted to compress the trigger switch 270 whereupon the trigger switch 270 compresses the circuit board 27 and generates a trigger signal to the control circuit 273. The control circuit 27 exerts a control current to the magnetic portion 246 of the driver 24 in a predetermined time so that the magnetic portion 246 adjacent to the outer shell 240 and magnetic end of the outer shell 240, match. Moreover, the driving portion 247 extends out of the hatch 244 via repulsive electromagnetic force, and the two reset springs 242 are compressed by the magnetic portion 246. The connecting block 232 of the limitation frame 23 is pushed by the driving portion 247 towards the second guiding groove 221, the fixing groove 235 is engaged with the hook pole 13, and the positioning bar 236 is meshed with the protrusion 224, so that, the lighting member 10 is attached to the fixed base 20. Simultaneously, the control circuit 273 exerts a current to the electrode 14 by the touch pole 260 to make the luminophor 11 light up. When the lit time of the luminophor 11 exceeds a predetermined time, the control circuit 273 stops providing current for the magnetic portion 246, and results in the disappearance of repulsive electromagnetic force between the magnetic portion 246 and the magnetic end of the outer shell 240, so that the magnetic portion 246 draws the magnetic end of the outer shell 240 by pressure from the two reset springs 242, and the driving portion 247 returns inside the outer shell 240 via the hatch 244.

Because a curved chamfer is formed at a junction between the sliding groove 234 and the fixing groove 235, when rejecting the support column pole 12 from the fixed base 20, the hook pole 13 is slid from the fixing groove 235 to the sliding groove 234, and ejected via the hatch 218. Simultaneously, the frame body 230 of the limitation frame 23 is extruded by the hook pole 13, and starts to move toward the driver 24, and the positioning bar 236 returns to its original position, completing a cycle.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A fixed base for receiving a lighting member comprising:

an upper cover comprising:

an outer canister comprising a top plate and a sidewall, wherein the sidewall encircles the top plate to form a receiving room, an inner canister penetrating the receiving room and attached to the top plate, and comprising a wall, at least one hatch defined in the wall, and connecting with the receiving room, a positioning component set in the inside surface of the top plate;

a limitation frame comprising:

a frame body, a connecting block and a positioning block oppositely set in two ends of the frame body respectively, wherein the frame body encircles the inner canister; the positioning block is slidably connected to the positioning component, at least one groove opposite to the hatch defined in a wall of the frame body, and the at least one groove comprising a sliding groove and a fixing groove connected to the sliding groove;

a driver opposite to the connecting block; and a trigger switch, wherein the trigger switch generates a trigger signal to drive the driver to drive the limitation frame to engage the lighting member when receiving a pressure whose value exceeds a predetermined value, thereby securing the lighting member to the fixing base.

2. The fixed base as described in claim 1, further comprising a circuit board electronically connected to the driver, and fixed in the inside of the receiving room, wherein the trigger switch is mounted on the circuit board, and the circuit board comprises a control circuit electronically connected to the trigger switch and the driver, and the control circuit is configured for driving the driver according to the trigger signal from the trigger switch.

3. The fixed base as described in claim 2, wherein the inner canister comprises a bottom plate connected to the wall, at least one first through hole is defined in the bottom plate, and the fixed base further comprises a touch component comprising a substrate plate and at least one touch pole mounted on the substrate plate, the at least one touch pole is extended in the inside of the inner canister by the at least one first through hole, and the substrate plate is touched with the trigger switch, and the touch component is configured for triggering the trigger switch to generating the trigger signal when the at least one touch pole is exerted a pressure whose value exceeds a predetermined value.

4. The fixed base as described in claim 3, further comprising a lower cover and at least two bolts, wherein, at least two nuts are set in one side of the receiving room toward the bottom plate, at least two cutouts are defined in the edge of the substrate plate and are placed to engage the at least two nuts, thereby engaging the substrate plate with at least two nuts, and at least two threaded holes are defined in the circuit board and the lower cover respectively, and the two bolts penetrate the two threaded holes of the lower cover and the two threaded holes of the circuit board in turn, are screwed with the nuts, thereby fixing the lower cover into the circuit board.

5. The fixed base as described in claim 1, wherein, a first guiding groove, a second guiding groove and a third guiding groove are defined in the inside surface of the top plate, the second guiding groove and the third guiding groove are located in the inside of the first guiding groove, and the limitation frame is slidably set in the inside of the second guiding groove, and the positioning component is set in one side of the second guiding groove, and the positioning block is located in the inside of the second guiding groove, and the driver is set in the third guiding groove, and the connecting block is located in the inside of the third guiding groove.

6. The fixed base as described in claim 5, further comprising a mid-plate, wherein a second through hole is defined in the mid-plate, and the second through hole is placed over the inner canister, and the mid-plate is configured for enveloping the limitation frame and the driver in the inside of the receiving room.

7. The fixed base as described in claim 1, wherein a positioning bar is set in one side of the positioning block, and a protrusion is protruded from a curved side of the positioning component, and the positioning bar is meshed with the protrusion.

8. The fixed base as described in claim 1, wherein the frame body is oval-shaped.

9. A lighting device comprising:

a lighting member comprising a luminophor and a support column pole connected to the luminophor, at least one hook pole set in the side surface of the support column pole;

a fixed base comprising:

an upper cover comprising:

an outer canister comprising a top plate and a sidewall, wherein the sidewall encircles the top plate to form a receiving room, an inner canister penetrating the receiving room and attached to the top plate, and comprising a wall, at least one hatch opposite to the hook pole defined in a wall of the inner canister, and connecting with the receiving room, a positioning component set in the inside surface of the top plate and a limitation frame comprising:

a frame body, a connecting block and a positioning block oppositely set in both ends of the frame body respectively, wherein the frame body encircles the inner canister, the positioning block is slidably connected to the positioning component, at least one groove opposite to the hatch defined in the wall of the frame body, and the groove comprising a sliding groove and a fixing groove connected to the sliding groove;

a driver opposite to the connecting block; and a trigger switch, wherein the trigger switch generates a trigger signal to control the driver to drive the limitation to move toward the positioning block, thereby making the hook pole sliding from the sliding groove to the fixing groove when the hook pole is inserted into the sliding groove along the hatch.

10. The lighting device as described in claim 9, wherein the fixed base further comprises a circuit board electronically connected to the driver, and the circuit board is fixed in the inside of the receiving room; the trigger switch is set in the circuit board, and the circuit board comprises a control circuit electronically connected to the trigger switch and the driver, and the control circuit is configured for driving the driver according to the trigger signal from the trigger switch.

11. The lighting device as described in claim 10, wherein the inner canister comprises a bottom plate connected to the wall, at least one first through hole is defined in the bottom plate, and the fixed base further comprises at least one touch component comprising a substrate plate and at least one touch pole set in the substrate plate, the at least one touch pole is extended in the side of the inner canister by the at least one first through hole, and the substrate plate is touched with the trigger switch, and the touch component is configured for triggering the trigger switch to generating the trigger signal when the at least one hook pole is inserted into the sliding groove.

12. The lighting device as described in claim 11, wherein at least two electrodes opposite to the touch pole are set in the bottom of the support column pole, and the touch pole is electronically connected to the substrate plate, and the substrate plate is electronically connected to the control circuit, and the control circuit is configured for providing a current for the two electrodes by the substrate plate and the touch pole when the hook pole is inserted into the sliding groove.

13. The lighting device as described in claim 11, wherein the fixed base comprises a lower cover and at least two bolts, and at least two nuts are set in one side of the receiving room toward the bottom plate, at least two cutouts are set in the edge of the substrate plate, and are placed over the at least two nuts, thereby engaging the substrate plate among at least two nuts, and at least two threaded holes are defined in the circuit board and the lower cover, and the two bolts are penetrate the two threaded holes of the lower cover and the two threaded holes of the circuit board in turn, are screwed with the nuts, thereby fixing the lower cover into the circuit board.

14. The lighting device as described in claim 9, wherein a first guiding groove, a second guiding groove and a third guiding groove are defined in the inside surface of the top plate, and the second guiding groove and the third guiding groove are located in the inside of the first guiding groove, and the limitation frame is slidably set in the inside of the second guiding groove, and the positioning component is set in one side of the second guiding groove, and the positioning block is located in the inside of the second guiding groove, and the driver is set in the third guiding groove, and the connecting block is located in the inside of the third guiding groove.

15. The lighting device as described in claim 14, wherein the fixed base further comprises a mid-plate, and a second through hole is defined in the mid-plate, and the second through hole is placed over the inner canister, and the mid-plate is configured for enveloping the limitation frame and the driver in the inside of the receiving room.

16. The lighting device as described in claim 9, wherein a positioning bar is set in one side of the positioning block, and a protrusion is protruded from a curved side of the positioning component, and the positioning bar is meshed with the protrusion.

17. The lighting device as described in claim 9, wherein the frame body is oval-shaped.

* * * * *